US005951111A

United States Patent [19]

Klimenko

[11] Patent Number: 5,951,111

[45] Date of Patent: Sep. 14, 1999

[54] INFLATABLE SOFA

[75] Inventor: K. "Conny" Klimenko, Los Angeles, Calif.

[73] Assignee: Sevylor U.S.A., Inc., Los Angeles, Calif.

[21] Appl. No.: 09/037,985

[22] Filed: Mar. 11, 1998

[51] Int. Cl.[6] ..... A47C 7/02

[52] U.S. Cl. ..... 297/452.41; 297/421; 297/188.09; 297/188.14; 297/DIG. 8

[58] Field of Search ..... 297/180.1, 180.15, 297/188.12, 188.08, 188.09, 452.41, DIG. 8, 188.14; 5/421, 681, 706, 654, 655.3

[56] References Cited

U.S. PATENT DOCUMENTS

| | | | |
|---|---|---|---|
| 3,408,107 | 10/1968 | Savage | 297/452.41 |
| 3,712,674 | 1/1973 | Ando | 297/452.41 |
| 3,740,095 | 6/1973 | Nail | 297/452.41 |
| 3,831,209 | 8/1974 | Clingman . | |
| 4,060,276 | 11/1977 | Lindsay | 5/421 |
| 4,484,781 | 11/1984 | Phelps | 297/452.41 |
| 4,907,997 | 3/1990 | Hall . | |
| 5,162,007 | 11/1992 | Leslie . | |
| 5,163,694 | 11/1992 | Reichek . | |
| 5,233,705 | 8/1993 | Coleman et al. . | |
| 5,403,220 | 4/1995 | Goad, Sr. . | |
| 5,516,188 | 5/1996 | Bruhnke et al. | 297/452.41 |
| 5,518,431 | 5/1996 | Staley . | |
| 5,580,132 | 12/1996 | Rediske | 297/452.41 |
| 5,729,840 | 3/1998 | Wu . | |
| 5,860,705 | 1/1999 | Ridder | 297/452.41 |

FOREIGN PATENT DOCUMENTS

| | | | |
|---|---|---|---|
| 2448810 | 10/1974 | Germany | 297/452.41 |
| 1062102 | 12/1983 | U.S.S.R. . | |

*Primary Examiner*—Laurie K. Cranmer
*Attorney, Agent, or Firm*—Dean W. Russell; Kilpatrick Stockton LLP

[57] ABSTRACT

Disclosed is an inflatable sofa which can be quickly inflated for use or deflated for convenient storage and transporting. At least one recess is formed in a seat portion of the inflatable sofa for accommodating heat-absorbing material to make the sofa more comfortable for sitting. Containers with accordion bodies for holding cups or cans are connected to armrest portions of the inflatable sofa by radio heating and form an integral part of the inflatable sofa.

13 Claims, 4 Drawing Sheets

INFLATABLE SOFA

BACKGROUND OF THE INVENTION

There are various types of sofas available in the markets. Most of these sofas are designed to have framework made of rigid or hard materials and are therefore bulky and heavy. Each such sofa with rigid framework occupies a fixed space and can not be easily moved due to its volume and weight. For these reasons, sofas are generally limited to indoor use. However, people pay more and more attention to their outdoor activities at leisure time and would prefer to have a comfortable sofa which has simple structure and light weight and can be conveniently transported for use indoors and/or outdoors. It is therefore tried by the inventor to develop an inflatable sofa which is simple and light and can be quickly inflated for use or deflated for convenient transporting or storage without occupying too much space.

SUMMARY OF THE INVENTION

A primary object of the present invention is to provide an inflatable sofa that has simple structure and can be manufactured at low cost, and can be quickly inflated to provide comfortable softness for use indoors or outdoors, or be deflated for convenient storage without occupying too much space. The inflatable sofa according to the present invention is formed from multiple pieces of specially shaped plastic sheets connected to one another by radio heating. The radio heated plastic sheets enclose an inner space into which air can be filled via a valve. I-shaped supporting beams made of plastic material with high tensile strength are radio heated in armrest portions and/or the seat portion of the inflatable sofa for reinforcing purposes. The armrest portions are also provided with accordion containers for holding cups or cans. Recess is formed at the seat portion of the inflatable sofa for accommodating heat-absorbing material therein to cool a cushion positioned on the seat portion.

DETAILED DESCRIPTION OF THE PREFERRED EMBODIMENTS

Figure 1:
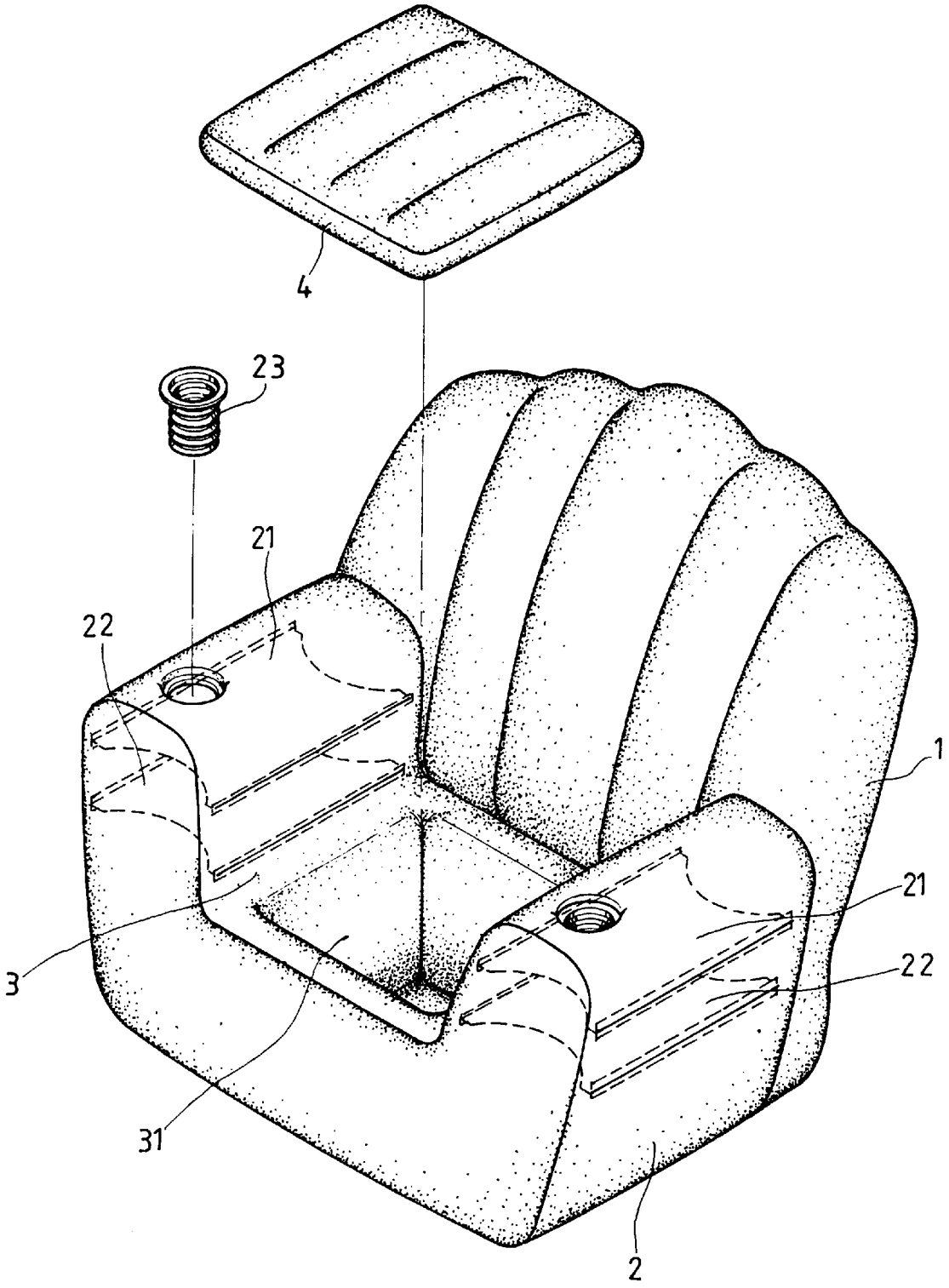
FIG. 1 is an exploded perspective of an inflatable sofa of the present invention in a fully inflated state.
Figure 2:
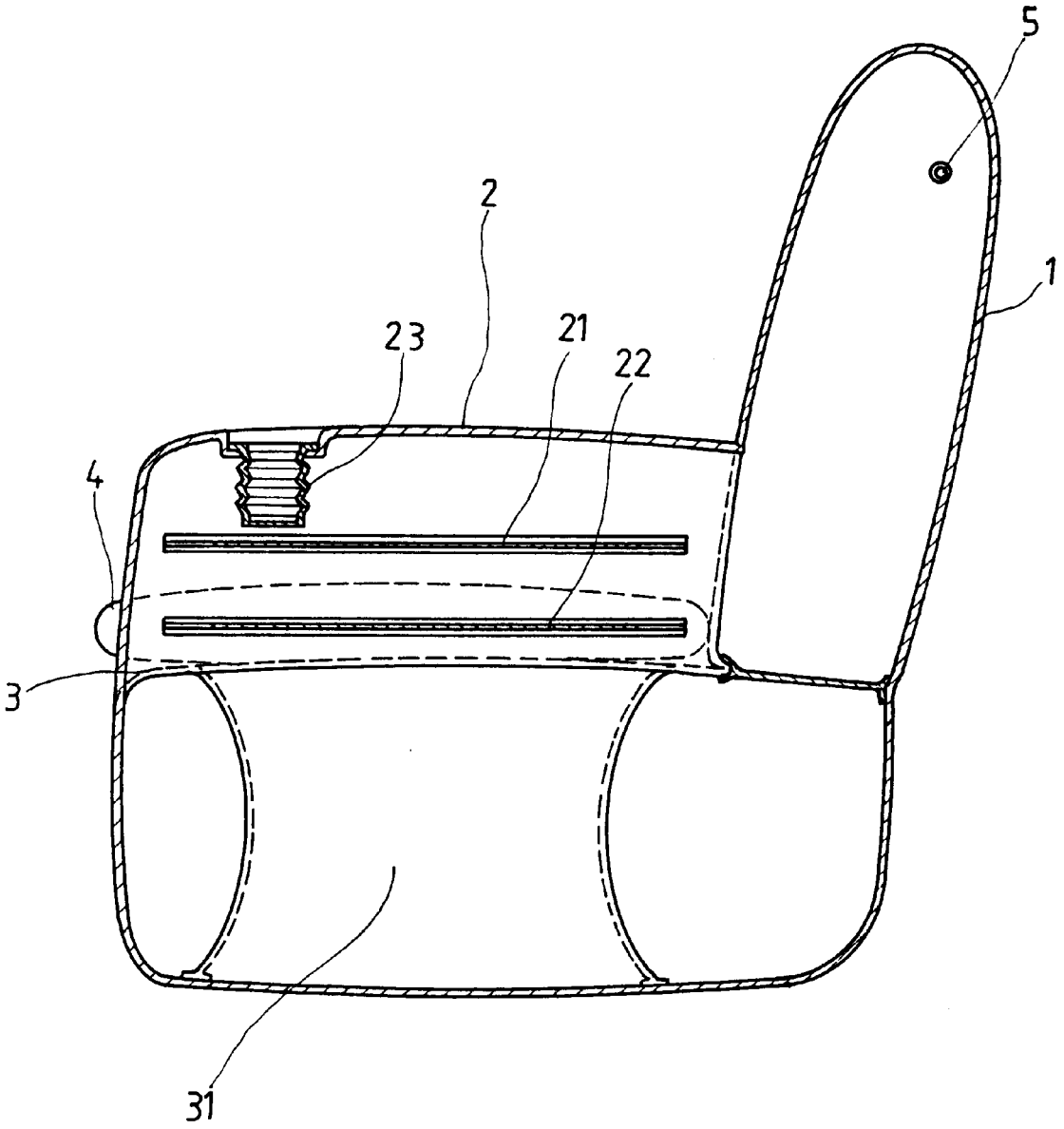
FIG. 2 is a side sectional view of the inflatable sofa of FIG. 1.
Figure 3:
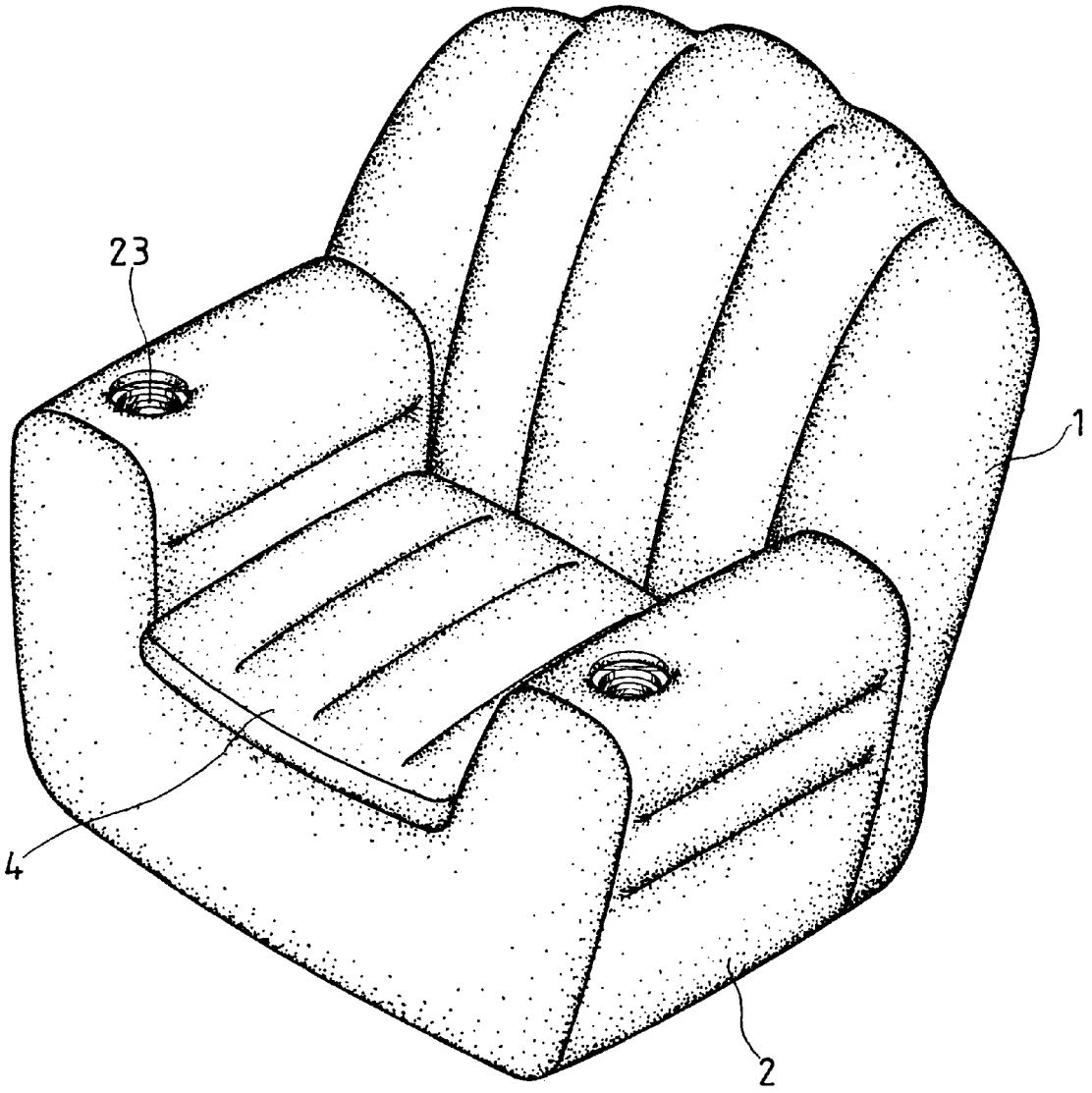
FIG. 3 is an assembled perspective of the inflatable sofa of FIG. 1.

Please refer to FIGS. 1, 2 and 3 at the same time. The present invention relates to an inflatable sofa made of multiple pieces of specially shaped plastic sheets connected to one another via radio heating. The inflatable sofa is designed to have a back portion 1, two armrest portions 2, a seat portion 3, and a separate seat cushion 4. A valve 5 is provided at a predetermined suitable position on the sofa for filling air into an inner space enclosed by the radio-heated plastic sheets. The inner space allows air inside the sofa to communicate among different portions of the sofa.

Supporting beams 21, 22 made of plastic material with high tensile strength and having an I-shaped cross section are transversely provided inside the two armrest portions 2 by radio heating their two end surfaces to inner surfaces of the plastic sheets forming the armrest portions 2, so that portions of the inner space in the armrests 2 are reinforced.

Two openings are separately formed on top surfaces of the two armrest portions 2 at predetermined suitable positions. The openings are provided with downward and then radially inward extended frames. A plastic container 23 having an accordion body and a radially outward extended top flange is disposed in each opening with the top flange overlapping the frame of the opening and being connected thereto by radio heating, so that the accordion containers 23 form an integral part of the inflatable sofa. The accordion container 23 each encloses a space suitable for accommodating a cup, a can or the like. Since the containers 23 have an accordion body, they are collapsible and foldable along with the inflatable sofa when the sofa is deflated.

The seat portion 3 is designed to have a downward extended central recess 31. Depending on the need of users, products with heat absorbing ability, such as ice cubes and/or ice bags, may be put in the recess 31 to make the whole seat portion 3 cool and comfortable.

The seat cushion 4 is designed to have wavy surfaces, so that it is comfortably soft for sitting.

Figure 4:
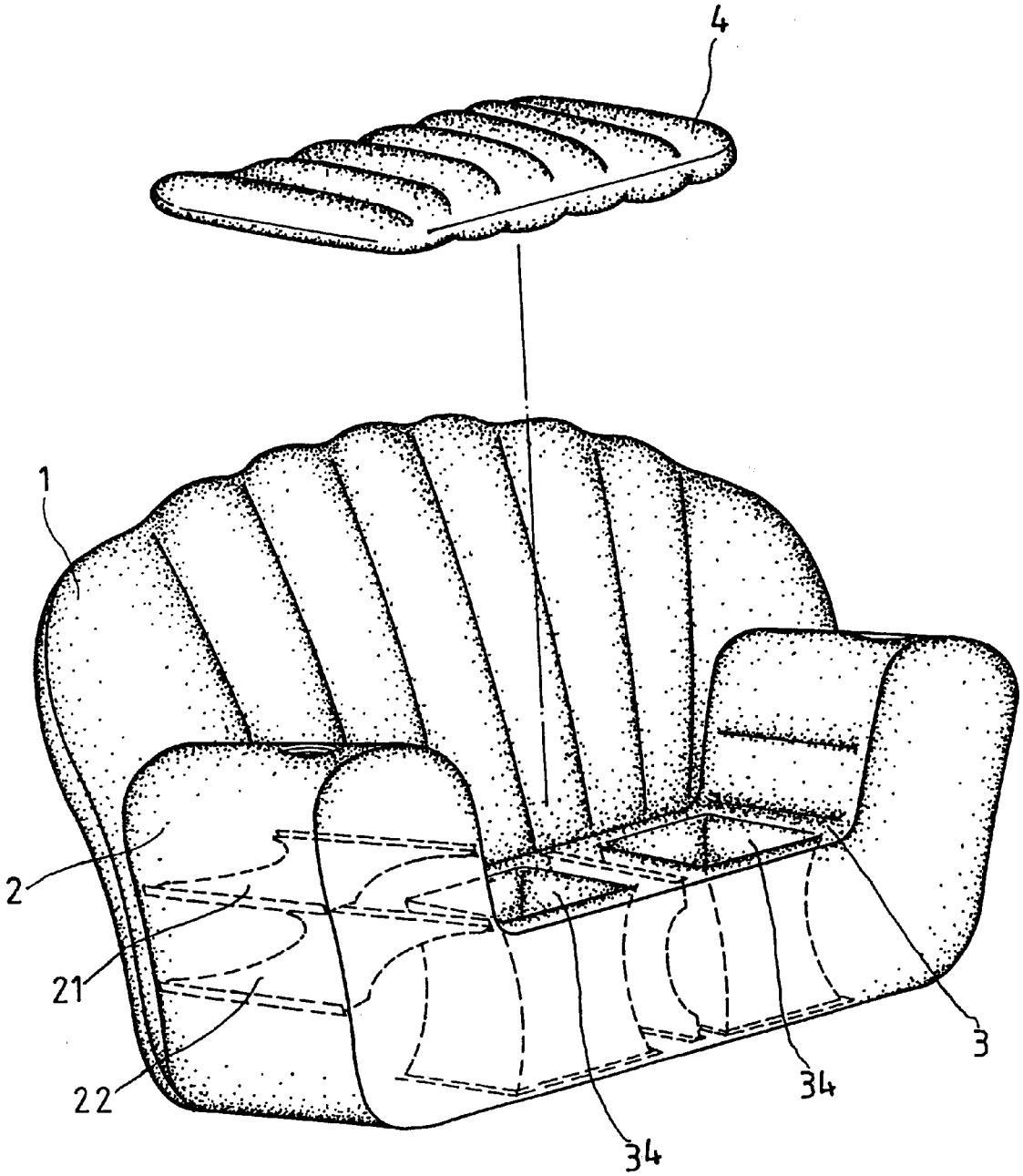
FIG. 4 is an exploded perspective of another embodiment of the present invention.

FIG. 4 illustrates an inflatable sofa with two seats. This two-seat sofa has generally the same structure as that of the sofa with one seat, except that multiple I-shaped supporting beams 34 are vertically provided in the space below the seat portion 3 to reinforce the seat portion 3. The supporting beams 31 are connected at their end surfaces to inner surfaces of the plastic sheets forming top and bottom surfaces of the seat portion 3 by radio heating.

The inflatable sofa provided by the present invention has simple structure and can be manufactured at low cost. Moreover, it can be quickly inflated for use and can be conveniently stored without occupying too much space after it is deflated. The accordion containers 23 and the recess 31 further increase the convenience and comfortableness of the inflatable sofa in use.

What is claimed is:

1. An inflatable sofa comprising multiple plastic sheets connected to one another to form a back portion, two armrest portions, a seat portion, and a separate seat cushion of said sofa and a valve provided on said sofa at a predetermined suitable position for filling air into an inner space enclosed by said plastic sheets; wherein said two armrest portions are each provided at a predetermined suitable position with an opening having a downward and then radially inward extended frame, a plastic container having an accordion body and a radially outward extended top flange being disposed in said opening with said top flange overlapping said frame of said opening and being connected thereto so that said accordion container forms an integral part of said respective armrest portion for accommodating a cup, a can or the like therein.

2. An inflatable sofa as claimed in claim 1, wherein said two armrest portions are reinforced by multiple I-shaped supporting beams made of plastic material with high tensile strength, said supporting beams being transversely connected at their end surfaces to inner surfaces of said plastic sheets forming said armrest portions by radio heating, so that portions of said inner space below said armrest portions of said inflatable sofa are reinforced.

3. An inflatable sofa as claimed in claim 2, wherein said seat portion includes at least one downward extended central recess, and said separate seat cushion being removably positioned over said at least one recess.

4. An inflatable sofa as claimed in claim 1, wherein said seat portion includes at least one downward extended central recess, and said separate seat cushion being removably positioned over said at least one recess.

5. An inflatable sofa as claimed in claim 4, wherein said at least one recess has heat-absorbing material accommodated therein to cool said seat cushion covered over said at least one recess and make said inflatable sofa more comfortable for sitting.

6. An inflatable object for supporting a seated person, comprising:

a. a body defining an inflatable interior region and a recessed area at least partially surrounded by the inflatable interior region, the recessed area adapted to receive and contain liquid or solid material when in use; and b. a cushion placed on the body when in use so as at least partially to cover the recessed area, the cushion being sufficiently movable when in use as to allow access to any liquid or solid material contained in the recessed area.

7. An inflatable object according to claim 6 in which the cushion is inflatable.

8. An inflatable object according to claim 6 in which the body defines an armrest portion having an opening in which a plastic container is disposed for receiving a cup or can.

9. An inflatable object according to claim 8 in which the plastic container is collapsible when the interior region is deflated.

10. An inflatable body for supporting a seated person, the body defining (i) an inflatable interior region, (ii) an armrest portion having an opening, and (iii) a separate container disposed in the opening and connected to the armrest portion for receiving a cup or can, the container being collapsible when the interior region is deflated.

11. An inflatable body according to claim 10 in which the container is plastic.

12. An inflatable body according to claim 10 in which the container has an accordion body.

13. An inflatable object for supporting a seated person, comprising:

a. a body defining an inflatable interior region and a recessed area at least partially surrounded by the inflatable interior region, the recessed area adapted to receive and contain liquid or solid material when in use; and b. a cushion placed on the body when in use so as to contact the seated person, the cushion being sufficiently movable when in use if necessary to allow access to any liquid or solid material contained in the recessed area.

* * * * *